US010208362B2

(12) United States Patent
Liu et al.

(10) Patent No.: US 10,208,362 B2
(45) Date of Patent: Feb. 19, 2019

(54) HT550 STEEL PLATE WITH ULTRAHIGH TOUGHNESS AND EXCELLENT WELDABILITY AND MANUFACTURING METHOD OF THE SAME

(71) Applicant: BAOSHAN IRON & STEEL CO., LTD., Shanghai (CN)

(72) Inventors: Zicheng Liu, Shanghai (CN); Xianju Li, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 456 days.

(21) Appl. No.: 14/889,052

(22) PCT Filed: Mar. 26, 2014

(86) PCT No.: PCT/CN2014/074084

§ 371 (c)(1),
(2) Date: Nov. 4, 2015

(87) PCT Pub. No.: WO2014/201887

PCT Pub. Date: Dec. 24, 2014

(65) Prior Publication Data

US 2016/0122844 A1 May 5, 2016

(30) Foreign Application Priority Data

Jun. 19, 2013 (CN) ..... 2013 1 0244712

(51) Int. Cl.
*C21D 9/46* (2006.01)
*C21D 8/02* (2006.01)
(Continued)

(52) U.S. Cl.
CPC ..... *C21D 9/46* (2013.01); *B22D 7/00* (2013.01); *C21D 1/60* (2013.01); *C21D 1/84* (2013.01);
(Continued)

(58) Field of Classification Search
CPC ..... C21D 2211/002; C21D 2211/008; C21D 8/0226; C21D 8/0236; C21D 8/02763;
(Continued)

(56) References Cited

FOREIGN PATENT DOCUMENTS

CA 2491307 A1 8/2005
CN 101289728 A 10/2008
(Continued)

OTHER PUBLICATIONS

PCT International Search Report, PCT/CN2014/074084, dated Jul. 3, 2014, 4 pages.

*Primary Examiner* — Veronica F Faison
(74) *Attorney, Agent, or Firm* — Quarles & Brady LLP

(57) ABSTRACT

An HT550 steel plate with ultrahigh toughness and excellent weldability and a manufacturing method thereof are disclosed. Based on a component system with ultralow-C, high-Mn, Nb-microalloying, ultramicro Ti treatment, Mn/C is controlled in the range of 15~30, (% Si)×(% Ceq) is less than or equal to 0.050, (% C)×(% Si) is less than or equal to 0.010, (% Mo)×[(% C)+0.13(% Si)] is in the range of 0.003~0.020, the ratio Ti/N is in the range of 2.0~4.0, the steel plate is alloyed with (Cu+Ni+Mo), Ni/Cu is greater than or equal to 1.0, Ca treatment is performed, and Ca/S is in the range of 0.80~3.00; by optimizing TMCP process, the steel plate has microstructures of fine ferrite plus self-tempered bainite with an average grain size being less than or equal to 15 μm, yield strength being 460 MPa or more, tensile strength being 550~700 MPa, yield ratio being 0.85 or less, and −60° C. Charpy impact energy (single value) being 60 J or more; therefore, the steel plate is capable of bearing large thermal input welding while obtaining uniform and excellent strength, toughness, and strong plasticity matching, and is especially suitable for sea bridge structures, ocean wind tower structures, ocean platform structures and hydroelectric structures.

2 Claims, 1 Drawing Sheet

(51) Int. Cl.

| | |
|---|---|
| ***C22C 38/14*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/16*** | (2006.01) |
| ***B22D 7/00*** | (2006.01) |
| ***C21D 1/60*** | (2006.01) |
| ***C21D 1/84*** | (2006.01) |
| ***C21D 6/00*** | (2006.01) |
| ***C22C 33/04*** | (2006.01) |
| ***C22C 38/08*** | (2006.01) |

(52) U.S. Cl.

CPC ..... *C21D 6/001* (2013.01); *C21D 6/005* (2013.01); *C21D 6/008* (2013.01); *C21D 8/02* (2013.01); *C21D 8/0205* (2013.01); *C21D 8/0226* (2013.01); *C21D 8/0247* (2013.01); *C21D 8/0263* (2013.01); *C22C 33/04* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C21D 2211/002* (2013.01); *C21D 2211/005* (2013.01)

(58) Field of Classification Search

CPC ..... C21D 8/0278; C21D 9/46; C21D 38/002; C21D 38/02; C21D 38/04; C21D 38/06; C21D 38/08; C21D 38/12; C21D 38/14; C21D 38/16; C21D 38/26; C21D 38/28; C21D 38/32

See application file for complete search history.

(56) References Cited

FOREIGN PATENT DOCUMENTS

| | | | |
|---|---|---|---|
| CN | 102676937 | A | 9/2012 |
| CN | 102719745 | A | 10/2012 |
| CN | 103320692 | A | 9/2013 |
| JP | 2008202119 | A | 9/2008 |
| JP | 2010077492 | A | 4/2010 |
| JP | 2011195883 | A | 10/2011 |
| JP | 2012167328 | A | 9/2012 |
| WO | 2006098198 | A1 | 9/2006 |

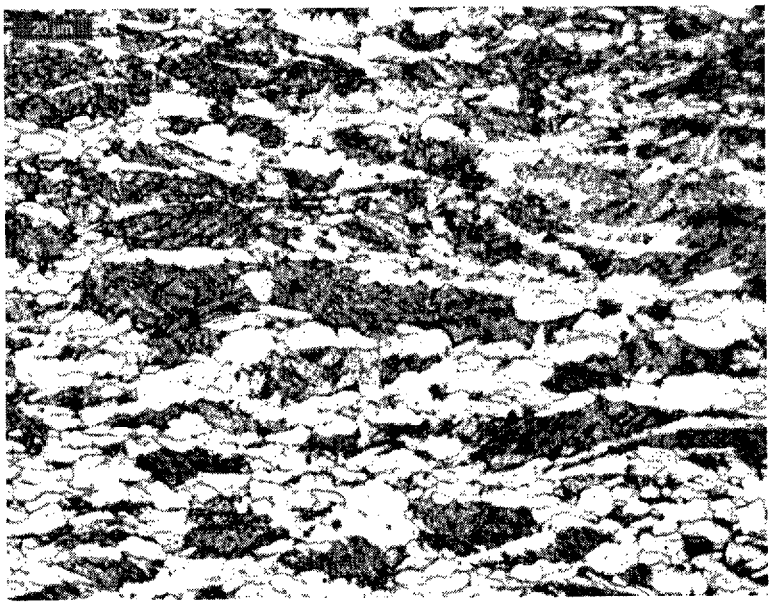
20 μm

HT550 STEEL PLATE WITH ULTRAHIGH TOUGHNESS AND EXCELLENT WELDABILITY AND MANUFACTURING METHOD OF THE SAME

CROSS-REFERENCE TO RELATED APPLICATIONS

This application represents the national stage entry of PCT International Application No. PCT/CN2014/074084 filed Mar. 26, 2014, which claims priority of Chinese Patent Application No. 201310244712.3 filed Jun. 19, 2013, the disclosures of which are incorporated by reference here in their entirety for all purposes.

TECHNICAL FIELD

The present invention relates to an HT550 steel plate with ultrahigh toughness and excellent weldability and a manufacturing method thereof. Through TMCP process, a steel plate with yield strength of 460 MPa or more, tensile strength of 550 MPa~700 MPa, yield ratio of 0.85 or less, −60° C. Charpy impact energy (a single value) of 60 J or more and excellent weldability, is obtained, which has microstructures of fine ferrites plus self-tempered bainite with an average grain size of less than 15 μm.

BACKGROUND

As is known, the low-carbon (high-strength) low-alloy steel is one of the most important engineering structure materials, and is widely applied into oil and gas lines, offshore platforms, ship buildings, bridge structures, boiler vessels, architectural structures, automobile industries, railway transportation, and mechanical productions.

The properties of the low-carbon (high-strength) low-alloy steel depend upon its chemical components and the process system in the manufacturing process, wherein the strength, plasticity, toughness and weldability are the most important ones thereof, which finally depend on the microstructures of the finished steel product. As the science and technology develops, higher requirements on the matching of high toughness and high plasticity of high-strength steel are put forward. That is to say, the mechanical properties and operational performance can be significantly improved while maintaining a low manufacture cost, so as to reduce the amount of used steel materials, save the cost, and reduce the self-weight of the steel structure, and more importantly, to further improve the safety, stability, durability and cold/hot machinability, to accommodate different construction environments and meet different requirements on the processes.

Currently, there is a climax in research and development on a new generation of high-performance steel and iron materials in Japan, Korea and European Union. Efforts have been made to optimize the alloy combinations and innovate the manufacturing processes so as to obtain a better match among structures, such that the high-strength steel can gain a better match between high toughness and high plasticity.

The traditional thick steel plate with a tensile strength of more than 590 MPa is fabricated by reheating and quenching plus tempering (RQ+T) that is so-called "offline hardening", which requires the central part of the steel plate to be of sufficiently high hardenability, i.e., the hardenability index DI is more than or equal to 1.0 multiplied by the thickness of the steel plate, wherein $DI=0.3110^{1/2}(1+0.64Si)\times(1+4.10Mn)\times(1+0.27Cu)\times(I+0.52Ni)\times(1+2.33Cr)\times(1+3.14Mo)\times25.4$ (mm), so as to ensure that the steel plate has sufficiently high strength, excellent ultra-low temperature toughness and uniform microstructures and properties along the thickness direction thereof. Consequently, a certain number of alloy elements such as Cr, Mo, Ni, Cu are inevitably added into the steel (JPS59-129724, JPH1-219121). Ni can not only improve the strength and hardenability of the steel plate but also reduce the phase-transition temperature and fine the grain sizes of lath bainite/martensite; more importantly, Ni is the only element for improving the intrinsic low-temperature toughness of lath bainite/martensite, increasing the orientation angle between the bainite/martensite lathes, and improving the resistance to expand cracks in the eutectic bainite/martensite. As such, the alloy content of the steel plate is high, which results in not only high production cost but also high carbon equivalent Ceq, and high welding cold crack sensitivity index Pcm. This brings large difficulties to the field welding, such that preheating is needed before welding, and heat treatment is needed after welding, whereby the welding cost becomes higher, the welding efficiency is reduced, and the welding environment becomes worse. A large number of prior patent documents (e.g. JPS63-93845, JPS63-79921, JPS60-258410, JPH4-285119A, JPH4-308035A, JPH3-264614, JPH2-250917, JPH4-143246, U.S. Pat. Nos. 4,855,106, 5,183,198, 4,137,104) describe only how to achieve the strength and low-temperature toughness of the base steel plate, but not on how to improve the welding performance of the steel plate and obtain excellent low-temperature toughness of the welding heat affected zone HAZ, nor how to ensure the hardenability of the central part of the hardened steel plate, to ensure the strength, toughness of the steel plate and the uniformity of the strength, toughness along the thickness direction thereof.

Currently, in term of improving the low-temperature toughness of the welding heat affected zone (HAZ) of the ultra-high heat input welded steel plate, only Nippon Steel Co. of Japan takes the oxide metallurgy technology (U.S. Pat. No. 4,629,505, WO 01/59167 AI), that is, during the high heat input welding process, TiN particles near the melting lines, dissolve under the strong effect of the high temperature, and fail. $Ti_2O_3$ is more stable than TiN, and does not dissolve even under the temperature of higher than the melting point of steel. $Ti_2O_3$ particles may become the nucleating sites of the austenite transgranular acicular ferrite-AF, in order to promote the nucleation thereof, divide the austenite grains effectively, fine the HAZ structure, and form high-strength high-toughness acicular ferrite-AF structures. Besides, Sumitomo Metal Co. of Japan takes the technical means of adding B, and controlling the ratio B/N higher than or equal to 0.5, low silicon, ultra-low aluminum, moderate N content, in order to solve the problem with the high heat input welding performance of 60 kg-level steel plates, which achieves good effects and has been applied to the engineering practice successfully (*Iron And Steel,* 1978, Vol. 64, Page 2205).

SUMMARY

The objective of the present invention is to provide an HT550 steel plate with ultrahigh toughness and excellent weldability and a manufacturing method thereof. Through TMCP process, the final steel plate product has microstructures of fine ferrites plus self-tempered bainite with an average grain size of less than 15 μm, yield strength of 460 MPa or more, tensile strength of 550 MPa~700 MPa, yield ratio of 0.85 or less, −60° C. Charpy impact energy (a single value) of 60 J or more. While obtaining the uniform and excellent match between high toughness and high plasticity, the steel plate can bear high heat input welding process, and especially be applied to the cross-sea bridge structures, ocean wind tower structures, offshore platform structures, and hydropower structures, and can realize the stable, low-cost and batch industrial production.

To achieve the above-mentioned objective, the technical solution of the present invention is:

The present invention takes the metallurgy technical means: based on a component system with ultralow-C, high-Mn, Nb-microalloying, ultramicro Ti treatment, Mn/C is controlled in the range of 15~30, (% Si)×(% Ceq) is less than or equal to 0.050, (% C)×(% Si) is less than or equal to 0.010, (% Mo)×[(% C)+0.13(% Si)] is in the range of 0.003~0.020, Ti/N is in the range of 2.0~4.0, the steel plate is alloyed with (Cu+Ni+Mo), Ni/Cu is greater than or equal to 1.0, Ca treatment is performed, and Ca/S is in the range of 0.80~3.00.

Specifically, the HT550 steel plate with ultrahigh toughness and excellent weldability of the present invention has the following components in weight percentages: C: 0.04%~0.09%; Si: less than 0.15%; Mn: 1.25%~1.55%; P: less than 0.013%; S: less than 0.003%; Cu: 0.10%~0.30%; Ni: 0.20%~0.60%; Mo: 0.05%-0.25%; Als: 0.030%-0.060%; Ti: 0.006%~0.014%; Nb: 0.015%~0.030%; N: less than 0.0050%; Ca: 0.001%~0.004%; the remaining being Fe and inevitable impurities; and simultaneously, the contents of the above-described elements have to meet the following relationships.

In terms of the relationship between C and Mn, the ratio Mn/C is more than or equal to 15 and less than or equal to 30, so as to ensure that the steel plate assumes in the ductile fracture region under the condition of −60° C. temperature, i.e., the shear area of Charpy impact sample notch is more than or equal to 50%, so as to ensure that the steel plate has excellent ultralow-temperature toughness, and −60° C. Charpy impact energy (single value) of 60 J or more.

(% Si)×(% Ceq) is less than or equal to 0.050, wherein Ceq=C+Mn/6+(Cu+Ni)/15+(Cr+Mo+V)/5, which ensures that the steel plate has excellent weldability, inhibits the formations of M-A islands in the high heat input welding HAZ, improves the ultralow temperature toughness of the high heat input welding HAZ, eliminates the local brittle zones of the welding joints, and improves the safety and reliabillity of the steel structure.

(% Si)×(% C) is less than or equal to 0.010, which may increase the phase-transition critical cooling speed of bainite, reduces the middle temperature phase-transition region, improves the formation of the pro-eutectoid ferrite, increases hardenability of the non-phase-transitioned austenite to promote the formation of bainite, ensures the microstructures of the steel plate subjected to TMCP are ferrite plus self-tempered bainite, and guarantees the ultralow temperature impact toughness of the steel palte; and besides, inhibits the preciptation of the M-A island in the high heat input welding HAZ, and improves the weldability and the ultralow temperature toughness of the welding HAZ.

The above two points guarantee the excellent welding performance of the steel plate.

Through TMCP process, a steel plate with yield strength of 460 MPa or more, tensile strength of 550 MPa~700 MPa, yield ratio of 0.85 or less, −60° C. Charpy impact energy (a single value) of 60 J or more and excellent weldability, is obtained, which has microstructures of fine ferrites plus self-tempered bainite with an average grain size of less than 15 μm.

(% Mo)×[(% C)+0.13(% Si)] is in the range of 0.003~0.020, which ensures that the strength caused by the reduction of C and Si is neutralized through adding the element Mo, and that through the matching design among the elements of C, Si, and Mo, the properties such as the strength, plasticity, weldability and ultralow temperature toughness, are balanced, such that the steel plate can have excellent ultralow temperature toughness and weldability, while the strength and plasticity of the steel plate meet the development objective, and the subsequent process window is large enough to perform the field practice easily.

The ratio Ti/N is in the range of 2.0~4.0, which ensures that the formed TiN particles are uniform and fine, the resistance to the Ostwald Ripening is high, and the austenite grains during the process of the slab heating and rolling are uniform and fine, the growth of the grains in the welding HAZ is inhibited, and the low temperature toughness of the high heat input welding HAZ is improved.

In term of the relationship between Cu and Ni, the ratio Ni/Cu is more than or equal to 1.0, which reduces the $Ar_3$, $Ar_1$ temperatures of the TMCP steel plates, and fines the microstructures thereof, and prevents the slab from copper brittleness while guranteeing the excellent low-temperature toughness of the base steel plate.

The relationship between Ca and S: the ratio Ca/S is in the range of 0.8~3.0, which gurantees nodulirization of the sulfides within the steel, and improves the high heat input weldablity of the steel plate while preventing the generation of the hot cracks during the high heat input welding process.

In the component design of the present invention:

C affects significantly the strength, low-temperature toughness, elongation, and weldability of the TMCP steel plate. From the perspective of improving the low-temperature toughness and weldability of the steel plate, it is desired that the C content shall be controlled in a low level; while from the perspectives of the matching of steel hardenability, high toughness and high plasticity in the steel plate, the ultralow temperature toughness, the control of the microstructures in the manufacturing process, and the fabricating cost, it is undesired that the C content is too low, due to that too low C content tends to result in too high crystal boundary migration rate, coarse grains in the base steel plate and welding HAZ, thereby degrading seriously the low-temperature toughness thereof; thus, the reasonable range of the C content is 0.04%~0.09%.

Si can promote the deoxidation of the molten steel and improve the strength of the steel plate, but for the molten steel which is deoxidated by Al, the dexidating effect of Si is not significant. Although Si can improve the strength of the steel plate, Si also harms seriously the ultralow temperature toughness, elongation and weldability of the steel plate; especially, in the case of high heat input welding, Si may not only promote the formation of M-A islands, but also make the size of the M-A islands coarse, more, and unevenly distributed, which harms seriously the toughness of the welding heat affected zone (HAZ). Thus the Si content shall be as low as possible. Taking into account the economy and operability during the steel making process, the Si content should be controlled below 0.15%.

Mn, as the most important element, has, in addition to improve the strength of the steel plate, but also has effects of enlarging the austenite phase region, reducing the $Ar_1$ and $Ar_3$ temperatures, fining the microstructures of the TMCP steel plate so as to improve the low-temperature toughness, and promoting the formation of the low-temperature phase-transition structure so as to improve the strength of the steel plate; but Mn tends to segregate during the solidification of the molten steel, and especially when the Mn content is high, it may not only result in the difficulties in the casting operation, but also the conjugate segregation with C, P, S, etc., especially when the C content in the steel is high, it may make the segregation and loosening of the cast central parts and the accumulation of the oxygen sulfide inclusions more serious. Serious segregation of the cast central parts may tend to form abnormal structures in the subsequent rolling and welding processes, which may result in lower low-temperature toughness and cracks in the welding joints of the steel plates. Accordingly, depending upon the range of the C content, the selection for a suitable range of Mn is very important for the TMCP steel plate. According to the component system and C content of the present invention, the suitable content of Mn is in the range of 1.25%~1.55%, and when the C content is high, the Mn content may be reduced properly; in contrast, when the C content is low, the content of Mn may be increased properly.

P, as the harmful impurity in the steel, has tremendously harmful effects on the mechanical properties, especially on the ultralow-temperature impact toughness, elongation, and weldability (especially the high heat input weldability) and the welding joint performance, and thus, theoretically, the content thereof is lower, the better. However, considering the operability and cost of the steel-making, the P content shall be controlled below or equal to 0.013% for the TMCP steel plate which needs high heat input welding, −60° C. toughness and excellent match between high toughness and high plasticity.

S, as the harmful impurity in the steel, has very harmful effect on the ultralow-temperature impact toughness of the steel, and more importantly, S combines with Mn to form MnS impurity, which may extend along the rolling direction due to its plasticity during the hot rolling process, and form MnS impurity band along the rolling direction, damaging seriously the low-temperature impact toughness, elongation, Z-orientation properties, weldability and welding joint properties. At the same time, S is the also the main element for generating hot brittleness during the hot rolling process, and theoretically, the content thereof is lower, the better. However, considering the operability, cost of the steel making and the principle of smooth logistics, the S content shall be controlled below or equal to 0.003% for the TMCP steel plates which requires high heat input welding, −60° C. toughness and excellent matching between high toughness and high plasticity.

Cu is also an element for austenite stabilization. The addition of Cu can also reduce the $Ar_1$ and $Ar_3$ temperatures, improve the hardenability and the weather resistance of the steel plate, fine the microstructures of TMCP steel plate, and improve the ultralow temperature toughness thereof. However, too much Cu, e.g. more than 0.30%, may cause copper brittleness, cracking surface of the casting blacking, inner cracks and especially the degradation of the properties of the welding joints of the thick steel plate; too few Cu, e.g. less than 0.10%, may have few effects. Thus, the Cu content shall be controlled in the range of 0.10%~0.30%. In addition to reduce the copper brittleness of the steel containing Cu and alleviate the intercrystalline cracking during the hot rolling process, more importantly, owing to that both Cu and Ni are elements for austenite stabilization, the addition of both Cu and Ni can significantly reduce the $Ar_1$ and $Ar_3$ temperatures and improve the driving force for the transition from the austenite to ferrite so as to cause austenite to change phases under lower temperatures, significantly fine the microstructure of the TMCP steel plate, increase the orientation angle between bainite lathes, improve the resistance to expand cracks in the eutectic bainite, thereby significantly improve the ultralow-temperature toughness of the TMCP steel plate.

The addition of Ni can improve the dislocation mobility of ferrite phases, promote the dislocation cross slip and enhance the intrinsic plasticity and toughness of the ferrite grain and bainite lathes; besides, Ni, as an element for austenite stabilization, can significantly reduce the $Ar_1$ and $Ar_3$ temperatures and improve the driving force for the transition from the austenite to ferrite so as to cause austenite to change phases under lower temperatures, significantly fine the microstructure of the TMCP steel plate, increase the orientation angle between bainite lathes, improve the resistance to expand cracks in the eutectic bainite, thereby significantly improve the ultralow-temperature toughness of the TMCP steel plate. Thus Ni has the functions of simultaneously improving the strength, elongation, and low-temperature toughness of the TMCP steel plate. The addition of Ni into steel, can also reduce the copper brittleness of the steel containing Cu, alleviate the intercrystalline cracking during the hot rolling process, and improve the hardenability and the weather resistance of the steel plate. Theoretically speaking, the higher the Ni content in steel is, the better. But too much Ni may harden the welding heat affected zone, and be harmful to the weldability of the steel plate and the SR properties of welding joints; at the same time, Ni is an expensive element, and considering the cost efficiency, the Ni content shall be controlled in the range of 0.20%~0.60%.

The addition of Mo can significantly improve the hardenability of the steel plate, and promote the formation of bainite during rapid cooling. However, Mo, as an element for the formation of strong carbide, can also increase the size of the eutectic bainite and reduce the orientation difference between the formed bainite lathes, so as to decrease the resistance to the cracks passing through the eutectic bainites. Therefore, Mo improves significantly the strength of the hardened steel plate, while reducing the low-temperature toughness and elongation of the TMCP steel plate. Besides, too much Mo may not only damage the elongation, high heat input weldability and welding joint properties of the steel plate seriously, but also increase the manufacture cost thereof. But it is of high efficiency to add Mo and reduce the C content to balance the high toughness and the high plasticity, improve the ultralow-temperature toughness and the weldability. Hence, comprehensively considering the effects on phase-transition strengthening, the low-temperature toughness of the base steel plate, the elongation and the weldability of Mo and the cost factors, the Mo content shall be controlled in the range of 0.05%~0.25%.

Als in steel can make the free [N] stable therein, and reduce the free [N] in the welding heat affected zone (HAZ), thereby improving the low-temperature toughness in the welding HAZ. Consequently, the floor limit of Als is controlled at 0.030%. However, the excessive Als in steel may result in not only difficulties in casting, but also a large number of dispersed acicular $Al_2O_3$ impurities, which are harmful to the endoplasmic integrity, the low-temperature toughness and the high heat input weldability, thus the ceiling limit of Als shall be controlled at 0.060%.

The Ti content is in the range of 0.006%~0.014%, which inhibits the excessive growth of the austenite grains in the processes of slab heating and hot rolling; and more importantly, inhibits the growth of the HAZ grains during the welding process, and improves the HAZ toughness. Secondly, owing to that the affinity between Ti and N is far higher than the affinity between Al and N, when Ti is being added, it is preferred that N is combined with Ti to form dispersed TiN particles, which significantly reduce the free

[N] in the welding heat affected zone (HAZ), thereby improving the low-temperature toughness in the welding HAZ.

The addition of a trace of Nb in steel is to perform the non-recrystallization controlled rolling, so as to improve the strength and toughness of the steel plate. When the Nb content is less than 0.015%, the effects on the controlled rolling are not achieved and the capability of strengthening the TMCP steel plate is insufficient. When the Nb content is more than 0.030%, the formation of bainite(Bu) and the secondary precipitation embrittlement of Nb (C, N) are induced under the high heat input welding condition, which may damage seriously the low-temperature toughness of the high heat input welding heat affected zone (HAZ). The Nb content shall be controlled in the range of 0.015%~0.030%, so as to get the optimized controlled rolling effects, realize the matching between the high toughness and high plasticity of the TMCP steel plate while not harmful to the toughness of the welding HAZ.

The N content in steel is difficult to control. In order to ensure the existence of solid solution [B] in the steel plate and prevent much AlN from precipitating along the grain boundaries of original austenite (which is harmful to the impact toughness of the steel plate), the N content in the steel plate is not more than 0.005%.

Ca in steel can, on the one hand, further purify the molten steel, and on the other hand, perform denaturating treatment on the sulfides in the steel to change them into non-deformable, stable and fine sphere sulfides, inhibit the hot brittleness of S, improve the low-temperature toughness, the elongation and Z-orientation properties, and enhance the anisotropy of the toughness of the steel plate. The amount of Ca added into the steel, depends upon the S content. Excessively low Ca content has few effects; excessively high Ca may form Ca(O, S) with excessively large size and larger brittleness, which may become the start points of the cracks, reduce the low-temperature toughness and elongation of the steel plate and contaminate the molten steel, thereby decreasing the degree of purity of the steel. Generally, the Ca content shall be controlled according to the equation: ESSP=(wt % Ca)[1−1.24(wt % O)]/1.25(wt % S), wherein ESSP is the controlling index of the shape of sulfide impurities, which is better in the range of 0.5~5. Thus, the proper range of the Ca content is 0.0010%~0.0040%.

The manufacturing method of the HT550 steel plate with ultrahigh toughness and excellent weldability of the present invention, comprises the following steps:

1) smelting and casting;
   wherein a slab is formed by smelting and casting according to the components described above;
2) heating
   wherein the heating temperature of the slab is controlled in the range of 1050° C.~1150° C.;
3) controlled rolling with the overall compression ratio, i.e. the slab thickness/final steel plate thickness of more than or equal to 4.0;
   wherein the first stage is the rough rolling stage, in which a continuous rolling is performed by the maximum capacity of the roller with the pass reduction of more than or equal to 8%, total reduction of 50% and final rolling temperature of more than or equal to 1000° C.;
   after the rough rolling, the intermediate slab is cooled rapidly by forced water cooling, so as to ensure that the intermediate slab reduces to the start rolling temperature required by the non-recrystallization controlled rolling in a time of less than or equal to 10 min, to prevent the intermediate slab from forming mischrcystal, and guarantee the microstructures of the steel plate uniform and fine, so as to obtain −60° C. ultralow-temperature toughness;
   in the second stage, the non-recrystallization controlled rolling operation is performed with a start rolling temperature of 780° C.~840° C., a rolling reduction in each pass of more than or equal to 7%, total reduction of more than or equal to 50% and a final rolling temperature of 760° C.~800° C.;
4) controlled cooling
   immediately after the controlled rolling, the steel plate is carried into an accelerated cooling device to be cooled, with a start cooling temperature of 690° C.~730° C., a cooling temperature of more than or equal to 6° C./s, a stop cooling temperature of 350° C.~600° C., and then the surface temperature of the steel plate is kept at higher than 300° C. for at least 24 hours.

In the manufacturing method:

According to the above-mentioned content range of C, Mn, Nb, N, and Ti, the temperature for heating the slab is controlled in the range of 1050° C.~1150° C., so as to ensure that the slab austenite grains do not grow abnormally while all Nb in steel is solid-soluted into austenite during heating slab;

The total compression ratio of the steel plate (the slab thickness/final steel plate thickness) of more than or equal to 4.0 ensures that the rolling deformation occurs even in the core of the steel plate, so as to improve the micro-structure and performance of the central part thereof;

The first stage is the rough rolling stage, in which a continuous rolling is performed by the maximum capacity of the roller with the reduction in each pass of more than or equal to 8%, total reduction of 50% and final rolling temperature of more than or equal to 1000° C., in order to ensure that the deformed metals are subjected to dynamic/static recrystallization and the austenite grains of intermediate slab is fined;

After the rough rolling, the intermediate slab is cooled rapidly by forced water cooling, so as to ensure that the intermediate slab reduces to the start rolling temperature required by the non-recrystallization controlled rolling in a time of less than or equal to 10 min;

The second stage is the non-recrystallization controlled rolling stage with a start rolling of 780° C.~840° C., a rolling reduction in each pass of more than or equal to 7%, total reduction of more than or equal to 50% and a final rolling temperature of 760° C.~800° C., according to the above Nb content range in steel, and to ensure the non-recrystallization controlled rolling effect;

After the controlled rolling, the steel plate is cooled to a start cooling temperature by swinging on a roller table, with the start cooling temperature of 690° C.~730° C., a cooling temperature of more than or equal to 6° C./s, a stop cooling temperature of 350° C.~600° C., and then the surface temperature of the steel plate is kept at higher than 300° C. for at least 24 hours, so as to ensure that the steel plate is cooled in the regions of ferrite and austenite phases and the final microstructures are fine ferrite plus self-tempered bainite, so as to achieve the yield ratio of less than or equal to 0.85.

The benefits of the present invention are:

Through the simple component combination design together with TMCP manufacturing process, the present invention can not only fabricate TMCP steel plate with excellent comprehensive performance with a low cost, but also shorten the manufacturing period significantly, so as to create large value for the enterprise and make the manufacturing process more environment-friendly. The high-performance and high additional value of the steel plate are embodied in having excellent matching between high toughness and high plasticity, excellent weldability (especially the high heat input weldability) and ultralow-temperature toughness, in eliminating the local brittle region of the welding joints, and also in solving the problem with non-uniform performance along the thickness direction of the TMCP steel plate, such that the safety, stability and anti-fatigue of the large and heavy steel structure is improved highly. For users, excellent weldability may save the cost and shorten the time for manufacturing the steel members, and thus create large value for users. In addition to the high additional value and environment-friendly effect, such steel plates form one of the core manufacturing techniques and thus promote the imagery and the core competitiveness of BAOSHAN IRON & STEEL CO., LTD.

BRIEF DESCRIPTION OF THE DRAWINGS

FIG. 1 is the microstructures of steel 3 (¼ of the thickness) according to an embodiment of the present invention.

DETAILED DESCRIPTION

Hereinafter, a further description of the present invention will be given in conjunction with the embodiments and figures.

Table 1 shows the components of the steel in the embodiments of the present invention, Table 2 and 3 show the process parameters for manufacturing the steel in the embodiments, and Table 4 shows the properties of the steel in the embodiments of the present invention.

As shown in FIG. 1, the final microstructures of the steel plate in the present invention are fine ferrite plus self-tempered bainite with an average grain size of 15 μm.

Through the simple component combination design together with TMCP manufacturing process, the present invention can not only fabricate TMCP steel plate with excellent comprehensive performance with a low cost, but also shorten the manufacturing period significantly, so as to create large value for the enterprises and make the manufacturing process more environment-friendly. The high-performance and high additional value of the steel plate are embodied in having excellent matching between high toughness and high plasticity, excellent weldability (especially the high heat input weldability) and ultralow-temperature toughness, in eliminating the local brittle region of the welding joints, and also in solving the problem with non-uniform performance along the thickness direction of the TMCP steel plate, such that the safety, stability and anti-fatigue of the large and heavy steel structure is improved highly. For users, excellent weldability may save the cost and shorten the time for manufacturing the steel members, and thus create large value for users.

The steel plates of the present invention are key materials mainly used for cross-sea bridge structure, ocean wind-tower structure, offshore platform structure and hydropower structure. The current steel plates produced by most of the steel plants in China (except BAOSHAN IRON & STEEL CO., LTD.) cannot meet all the requirements on ultralow-temperature toughness, especially on the −50° C. ultralow-temperature toughness of the central parts of the steel plates with a thickness of more than 80 mm, and they have large area of the local brittle region of the welding joints, which has high requirements on the field welding process and construction management. Besides, the work period of manufacturing the steel structure cannot meet the requirements on the varied project schedules, which forces users to order a certain number of steel plates in advance to perform a full set of welding process evaluation and filed welding process adaptability test, whereby the manufacturing period of the steel structures are prolonged and the production cost stay high.

With the development of the economy in China, the construction of the conservation-minded and harmonious society, the construction of infrastructure projects, and the development of clear energy, has been put on the agenda. Currently the construction of infrastructure projects and the clear energy development are still going on, therefore the key materials thereof—TMCP steel plates of HT550 with ultrahigh toughness and excellent weldability, have broad marketing prospects.

TABLE 1

Unit: Weight Percentage

| Steel Sample | C | Si | Mn | P | S | Cu | Ni | Mo | $Al_S$ | Ti | Nb | N | Ca | Fe and Impurities |
|---|---|---|---|---|---|---|---|---|---|---|---|---|---|---|
| Embo. 1 | 0.06 | 0.15 | 1.30 | 0.013 | 0.0018 | 0.10 | 0.20 | 0.05 | 0.036 | 0.009 | 0.022 | 0.0039 | 0.0020 | Remaining |
| Embo. 2 | 0.04 | 0.12 | 1.25 | 0.011 | 0.0014 | 0.26 | 0.27 | 0.11 | 0.030 | 0.006 | 0.030 | 0.0027 | 0.0040 | Remaining |
| Embo. 3 | 0.09 | 0.08 | 1.40 | 0.008 | 0.0006 | 0.23 | 0.30 | 0.18 | 0.060 | 0.010 | 0.015 | 0.0050 | 0.0012 | Remaining |
| Embo. 4 | 0.05 | 0.06 | 1.45 | 0.009 | 0.0030 | 0.30 | 0.40 | 0.21 | 0.042 | 0.012 | 0.018 | 0.0043 | 0.0032 | Remaining |
| Embo. 5 | 0.06 | 0.07 | 1.55 | 0.006 | 0.0012 | 0.25 | 0.60 | 0.25 | 0.039 | 0.014 | 0.017 | 0.0036 | 0.0010 | Remaining |

TABLE 2

| | | | | First Stage of Rolling (Rough Rolling) | | | Second stage of Rolling (Non-recrystalline Controlled Rolling) | | | | |
|---|---|---|---|---|---|---|---|---|---|---|---|
| | | Heating | Total | | | | Water Cooling Time of | Start | Minimum | | Final |
| Steel Sample | Thickness (mm) | Temp. of Slab (° C.) | Reduction in Rolling (%) | Minimum Pass Reduction (%) | Overall Reduction (%) | Final Rolling Temp. (° C.) | Intermediate Slab (min) | Rolling Temp. (° C.) | Pass Reduction (%) | Overall Reduction (%) | Rolling Temp. (° C.) |
| Embo. 1 | 16 | 1150 | 12.5 | 8 | 60 | 1030 | 3 | 840 | 8 | 80 | 800 |
| Embo. 2 | 40 | 1100 | 5.0 | 8 | 60 | 1020 | 5 | 820 | 7 | 67 | 790 |

TABLE 2-continued

| Steel Sample | Thickness (mm) | Heating Temp. of Slab (° C.) | Total Reduction in Rolling (%) | First Stage of Rolling (Rough Rolling) Minimum Pass Reduction (%) | Overall Reduction (%) | Final Rolling Temp. (° C.) | Second stage of Rolling (Non-recrystalline Controlled Rolling) Water Cooling Time of Intermediate Slab (min) | Start Rolling Temp. (° C.) | Minimum Pass Reduction (%) | Overall Reduction (%) | Final Rolling Temp. (° C.) |
|---|---|---|---|---|---|---|---|---|---|---|---|
| Embo. 3 | 60 | 1080 | 5.0 | 9 | 50 | 1015 | 8 | 800 | 7 | 60 | 780 |
| Embo. 4 | 80 | 1130 | 5.0 | 8 | 50 | 1050 | 10 | 790 | 8 | 60 | 770 |
| Embo. 5 | 100 | 1050 | 4.0 | 9 | 50 | 1000 | 10 | 780 | 8 | 50 | 760 |

TABLE 3

| Steel Sample | Thickness (mm) | Controlled cooling process Start Cooling Temp. (° C.) | Cooling speed (° C./sec.) | Stop Cooling Temp. (° C.) | Slow Cooling Process Temp./Time (° C. × hr.) | UT Inspection EN 10160 S2E3 level |
|---|---|---|---|---|---|---|
| Embo. 1 | 16 | 730 | 25 | 600 | 305 × 24 | GOOD |
| Embo. 2 | 40 | 700 | 15 | 550 | 325 × 36 | GOOD |
| Embo. 3 | 60 | 720 | 10 | 500 | 310 × 30 | GOOD |
| Embo. 4 | 80 | 690 | 8 | 450 | 325 × 28 | GOOD |
| Embo. 5 | 100 | 710 | 6 | 350 | 320 × 36 | GOOD |

TABLE 4

| Steel Sample | Rel/Rp0.2 MPa | Rm MPa | $\delta_5$ % | Central Transverse Akv(−50° C.)/(J) | Z-orientation Properties (° C.) | Preheating Temp. for Welding (° C.) | Welding Thermal Simulation Parameters: $T_{max}$ = 1350° C., $t_{8/5}$ = 80s Akv(−40° C.)/J |
|---|---|---|---|---|---|---|---|
| Embo. 1 | 529 | 647 | 26 | 279, 280, 277; 279 | 50, 52, 50; 50.7 | 0 | 136, 141, 148; 142 |
| Embo. 2 | 503 | 627 | 25 | 203, 256, 253; 238 | 51, 58, 52; 53.7 | 0 | 130, 96, 113; 113 |
| Embo. 3 | 556 | 669 | 26 | 142, 115, 153; 137 | 53, 55, 53; 53.7 | 0 | 113, 96, 94; 101 |
| Embo. 4 | 561 | 672 | 24 | 146, 156, 158; 153 | 55, 59, 54; 56.0 | 0 | 102, 88, 92; 94 |
| Embo. 5 | 572 | 686 | 27 | 112, 87, 152; 117 | 56, 55, 54; 55.0 | 0 | 63, 108, 77; 83 |

What is claimed is:

1. An HT550 steel plate with ultrahigh toughness and excellent weldability, consisting of, in weight percentage:

C: 0.04%~0.09%;

Si: less than or equal to 0.15%;

Mn: 1.25%~1.55%;

P: less than or equal to 0.013%;

S: less than or equal to 0.003%;

Cu: 0.10%~0.30%;

Ni: 0.20%~0.60%;

Mo: 0.05%~0.25%;

Als: 0.030%~0.060%;

Ti: 0.006%~0.014%;

Nb: 0.015%~0.030%;

N: less than or equal to 0.0050%;

Ca: 0.001%~0.004%; and the remaining being Fe and inevitable impurities;

and simultaneously, the contents of the above-described elements meeting the following relationships:

the relationship between C and Mn: the ratio Mn/C is more than or equal to 15 and less than or equal to 30;

(% Si)×(% Ceq) is less than or equal to 0.050, wherein Ceq=C+Mn/6+(Cu+Ni)/15+(Cr+Mo+V)/5;

(% Si)×(% C) is less than or equal to 0.010;

(% Mo)×[(% C)+0.13(% Si)] is in the range of 0.003~0.020;

the ratio Ti/N is in the range of 2.0~4.0;

the relationship between Cu and Ni: Ni/Cu is more than or equal to 1.0;

the relationship between Ca and S: the ratio Ca/S is in the range of 0.80~3.0;

the steel plate having yield strength of 460 MPa or more, tensile strength of 550 MPa~700 MPa, yield ratio of 0.85 or less, −60° C. Charpy impact energy (a single value) of 60 J or more, and the microstructures thereof being fine ferrites plus self-tempered bainite with an average grain size of less than 15 μm.

2. A manufacturing method of the HT550 steel plate with ultrahigh toughness and excellent weldability as claimed in claim 1, comprising the following steps:

1) smelting and casting;

wherein a slab is formed by smelting and casting according to the components described above;

2) heating wherein the heating temperature of the slab is controlled in the range of 1050° C.~1150° C.;

3) controlled rolling with the overall compression ratio, i.e. the slab thickness to the final steel plate thickness of more than or equal to 4.0;

wherein a first stage is a rough rolling stage, i.e., a recrystallization rolling stage, in which a continuous rolling is performed by the maximum capacity of the rolling mill with the pass reduction of more than or equal to 8%, total reduction of 50% and final rolling temperature of more than or equal to 1000° C.;

after the rough rolling, the intermediate slab is cooled rapidly by forced water cooling, so as to ensure that the intermediate slab reduces to the start rolling temperature required by the non-recrystallization controlled rolling in a time of less than or equal to 10 min;

in the second stage, the non-recrystallization controlled rolling operation is performed with a start rolling temperature of 780° C.~840° C., a rolling reduction in each pass of more than orequal to 7%, total reduction of more than or equal to 50% and a final rolling temperature of 760° C.~800° C.;

4) controlled cooling after the controlled rolling, the steel plate is cooled to a start cooling temperature by swinging on a roller table, with the start cooling temperature of 690° C.~730° C., so as to ensure that the steel plate is cooled in the regions of ferrite and austenite phases, and the final microstructures are fine ferrite plus self-tempered bainite, and with a cooling temperature of more than or equal to 6° C./s, a stop cooling temperature of 350° C.~600° C., and then the surface temperature of the steel plate is kept at higher than 300° C. for at least 24 hours; and the final steel plate having yield strength of 460 MPa or more, tensile strength of 550 MPa~700 MPa, yield ratio of 0.85 or less, −60° C. Charpy impact energy (a single value) of 60 J or more, and the microstructures thereof being fine ferrites plus self-tempered bainite with an average grain size of less than 15 μm.

* * * * *